US005205243A

United States Patent [19]

Buchholz

[11] Patent Number: 5,205,243

[45] Date of Patent: Apr. 27, 1993

[54] CRANKCASE BREATHER HAVING A FITTED RETAINER FOR RETAINING A VALVED CUP ASSEMBLY

[75] Inventor: Brian S. Buchholz, Malone, Wis.

[73] Assignee: Tecumseh Products Company, Tecumseh, Mich.

[21] Appl. No.: 857,742

[22] Filed: Mar. 26, 1992

[51] Int. Cl.[5] ..... F01M 13/00

[52] U.S. Cl. ..... 123/41.86; 123/572

[58] Field of Search ..... 123/41.86, 572, 574

[56] References Cited

U.S. PATENT DOCUMENTS

| | | | |
|---|---|---|---|
| 1,706,424 | 3/1929 | Vail | 123/41.86 |
| 2,571,893 | 10/1951 | Kendall | 136/178 |
| 3,051,151 | 8/1962 | Helwig | 123/572 |
| 3,087,474 | 4/1963 | Catha | 123/41.86 |
| 3,172,399 | 3/1965 | Lentz et al. | 123/572 |
| 3,359,960 | 12/1967 | Pittsley | 123/572 |
| 3,766,898 | 10/1973 | McMullen | 123/574 |
| 4,169,432 | 10/1979 | White | 123/41.86 |
| 4,579,092 | 4/1986 | Kandler | 123/41.86 |
| 4,779,601 | 10/1988 | Dallman | 123/572 |
| 4,926,814 | 5/1990 | Bonde | 123/196 W |
| 5,067,449 | 11/1991 | Bonde | 123/41.86 |

OTHER PUBLICATIONS

Tecumseh Products Company, *Mechanic's Handbook*, Form No. 692509, pp. 6–14, Publication Date Nov. 1985, Grafton, Wis.

*Primary Examiner*—Noah P. Kamen

*Attorney, Agent, or Firm*—Baker & Daniels

[57] ABSTRACT

A crankcase breather assembly for an internal combustion engine. A breather opening is provided in the crankcase for communication of combustion gases out from the crankcase interior. A breather unit is disposed in the opening and includes a cup having a valve therein for venting gases from the crankcase interior upon the condition of positive crankcase pressure. The breather unit further includes an elastic retaining member which covers and retains the cup therewith. The retaining member includes an integral breather tube. The retaining member further includes an outer groove that frictionally receives a peripheral edge of the opening to sealingly retain the breather unit in the opening without the use of fasteners.

15 Claims, 1 Drawing Sheet

CRANKCASE BREATHER HAVING A FITTED RETAINER FOR RETAINING A VALVED CUP ASSEMBLY

BACKGROUND OF THE INVENTION

The present invention relates generally to internal combustion engines, and more particularly, to a crankcase breather assembly for venting of crankcase gases.

Four cycle engines require a crankcase breather to rid the crankcase of pressures caused by blow-by gases escaping past worn piston rings and cylinder walls from the combustion chamber, by the downward force of the piston, and by expansion of the air in the crankcase from increasing heat. The buildup of pressure can eventually cause the oil seals to leak. In order to alleviate pressure buildup, a breather is installed in the crankcase.

Conventional breather valves include a reed valve in which a flexible metal strip is positioned over an opening in the crankcase. The reed opens on the downward piston stroke when the pressure differential between the atmosphere and the crankcase is sufficient to overcome the spring tension of the reed. A second type of breather valve is a disc-type valve that is generally made of a lightweight metal or plastic and moves perpendicular to an opening in the crankcase. The disc is spring biased or gravity biased to a closed position and opens to cover the opening in response to pressure changes.

A third type of breather valve is a molded flexible valve, commonly called a "mushroom" or "umbrella" valve. This valve has a center stem for attachment to a valve seat and covers a circular pattern of holes in the closed position. When crankcase pressure builds, the valve will flex upwardly to uncover the openings and vent the gases.

In U.S. Pat. No. 5,067,449, a crankcase breather assembly is disclosed wherein a plastic valve seat is press fit into a breather passage or opening in the crankcase. A flexible breather valve is secured to the valve seat for venting crankcase gases. In this disclosure, the breather chamber is formed by an upstanding wall that extends upwardly from the top wall of the crankcase. The breather chamber is closed at the top by a removable cover plate and a corresponding sealing gasket.

In some engines the breather chamber, valve seat, and valve are all incorporated into a molded plastic cup that is located in an opening in the crankcase. In particular, the flexible valve is attached to the bottom of the cup having the necessary valve openings therein. The cup is positioned within an opening in the crankcase, and a gasket is positioned over the molded flange at the top of the cup. A metal cover is then positioned over the gasket, and the entire assembly is held in place by several screws, which extend through the cover and crankcase. Some assemblies include a separate breather tube that is connected to the air cleaner assembly.

This breather assembly has performed effectively to maintain a partial vacuum in the crankcase as well as prevent oil from being forced out of the engine oil seals or past the piston rings or any gasket areas. Notwithstanding this successful performance, efforts are continuously directed toward more efficiently producing crankcase breather assemblies.

SUMMARY OF THE INVENTION

The present invention provides an improved crankcase breather assembly for an internal combustion engine including a cup having a breather valve operatively disposed therein, wherein a retaining member is provided for engaging and retaining the cup as a single unit, which unit is then insertable into a breather opening formed in the crankcase such that an outer portion of the retainer frictionally engages a peripheral edge of the opening, whereby the retaining member is securely and sealingly retained within the opening.

More particularly, the invention provides, in one form thereof, a retaining member in the form of a resilient rubberlike vented cover having an inner grooved surface that elastically receives and seals an upper protruding lip portion of the cup for covering the cup and securely retaining the cup as a single unit. In another embodiment, the retaining member may include a breather tube integral therewith.

In addition, the invention provides, in one form thereof, a retaining member having a grooved outer surface, wherein the retaining member may be simply pushed into an opening in the crankcase until the grooved outer surface frictionally and sealingly receives a protruding peripheral edge of the opening such that the retaining member is locked therein.

An advantage of the present invention is that the breather may be attached to the crankcase with fewer components and fewer labor intensive steps than conventional breather cup assemblies.

Another advantage of the present invention is that the breather may be inserted into a breather opening in the crankcase without the use of any special tools.

Yet another advantage of the present invention is that the breather may be reliably retained and sealed in the breather opening of the cylinder block without use of fasteners or secondary mechanical retention devices.

Yet another advantage of the present invention is that the breather retaining member forms a tight seal with the breather opening wall to effectively prevent the flow of gases or liquids therebetween.

Still another advantage of the present invention is that the retaining member comprises a vented cover including an inner groove which serves as a stop flange for providing a physical stop when the retaining member is installed in the breather opening, thereby assuring proper depth of insertion of the retainer.

Still another advantage of the present invention is that the retaining member sealingly covers the cup and includes a breather tube integral therewith.

The present invention, in one form thereof, provides an internal combustion engine having a crankcase and a crankcase interior. A crankcase breather assembly is provided for the venting of combustion gases from the crankcase interior. The assembly includes a breather opening in the crankcase for providing communication of gases out from the crankcase interior. A cup is provided in the opening and includes a valve for venting gases from the crankcase interior upon the condition of positive crankcase pressure. A retaining member is provided for engaging and retaining the cup and includes an outer groove that frictionally receives a peripheral edge of the opening, thereby retaining the retaining member in the opening.

In another embodiment thereof, the present invention provides a retaining member which includes a locking portion disposed in the opening at least partially beyond the peripheral edge, thereby forming an interference fit therein to positively lock the retaining member within the opening.

The invention further provides, in one form thereof, a method of assembling a crankcase breather assembly in an internal combustion engine having a crankcase interior. An opening is provided in the crankcase and includes a peripheral edge. A cup is provided including a valve disposed therein for venting gases from the crankcase interior upon the condition of positive crankcase pressure. A retaining member having a downwardly extending portion is attached over at least a portion of the cup to retain the cup and form a breather unit. The unit is then axially inserted into the opening such that a lower tip of the downwardly extending portion extends axially beyond the peripheral edge. Upon insertion, the downwardly extending portion is compressed inwardly by the peripheral edge to cause the lower tip to deform radially outwardly of the peripheral edge to lock the breather unit in place.

DESCRIPTION OF THE PREFERRED EMBODIMENT

Figure 1:
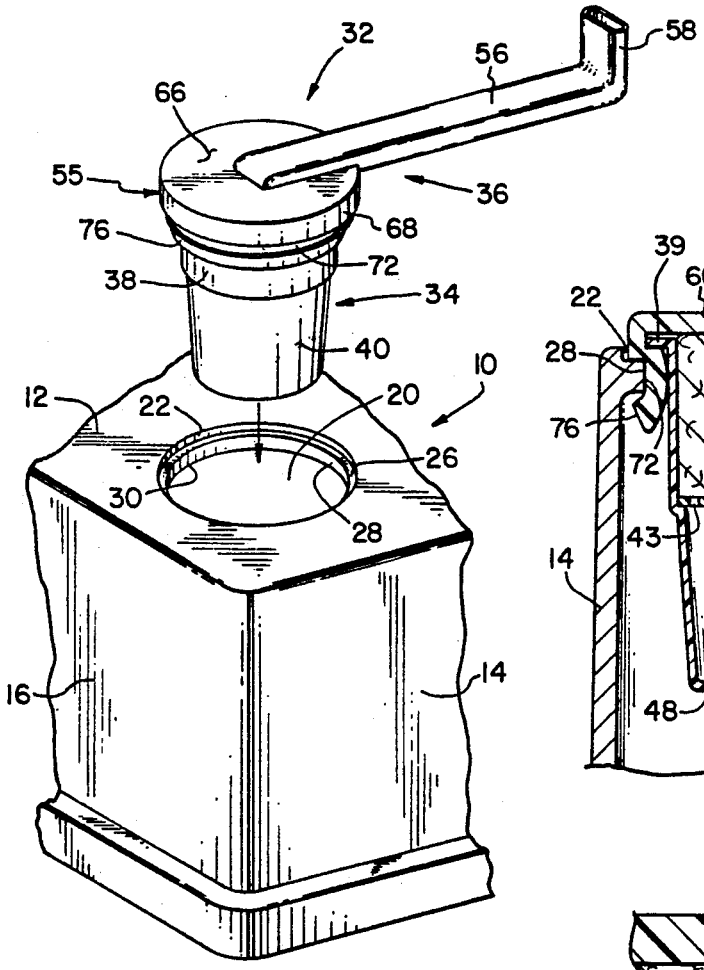
FIG. 1 is a perspective view of a breather assembly and a portion of an engine crankcase in accordance with the principles of the present invention, wherein a breather is shown ready for insertion into an opening in the engine crankcase.
Figure 2:
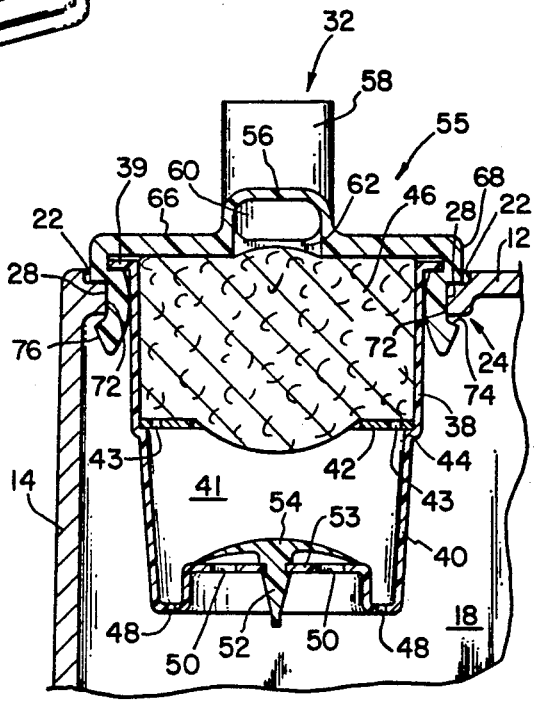
FIG. 2 is an enlarged vertical sectional view of the breather assembly of FIG. 1 installed in the crankcase.

Referring to FIG. 1, there is illustrated a portion of a crankcase 10 of an internal combustion engine, wherein crankcase 10 includes a generally horizontal top wall 12 and upstanding walls 14 and 16 integral with top wall 12 to circumscribe and define a crankcase interior 18 (FIG. 2). A breather opening 20 is provided in top wall 12 for permitting the venting of combustion gases therethrough to maintain a partial vacuum in crankcase interior 18. Opening 20 may be cast or machined but preferably machined for better control of tolerances. In addition, opening 20 may be of various sizes and shapes; however, for purposes of this discussion, opening 20 is generally annular in shape, as depicted in the drawings. Opening 20 includes an annular recess 22 and a laterally extending peripheral edge or flange 24. Flange 24 includes a mating surface 26, a vertical face 28, and a corner edge 30.

In order to control and direct the flow of combustion gases out of crankcase interior 18, a breather 32 is provided. Breather 32 generally comprises a cup 34 and a retaining member 36 for engaging the cup and sealingly retaining the cup within opening 20. Cup 34 is preferably made from a low cost engineering grade thermoplastic such as nylon 66 plastic to provide accurate dimensions and a smooth flat surface for proper valve action and sealing. Referring particularly to FIG. 2, cup 34 comprises an upper cylindrical portion 38 including a peripheral lip 39 and a lower slightly tapered portion 40, wherein both portions 38 and 40 define a breather chamber 41 therein. An annular baffle element 42, which includes oil return openings 43, is supported by a flange 44 within cup 34 as shown in FIG. 2. Baffle 42 supports a filter element 46, which substantially fills the volume of breather chamber 41 within cylindrical portion 38. The lower end of lower tapered portion 40 includes a plurality of oil return openings 48, and a valve seat 53 having a plurality of small circular exhaust gas openings 50 and a central stem opening (not shown) which receives stem 52 of a flexible valve member 54.

In operation, flexible breather valve 54 assumes an umbrella shape and initially sealingly engages the top surface of valve seat 53 such that valve 54 prevents fluid communication between crankcase interior 18 and breather chamber 41 . As combustion gases build up in crankcase interior 18, the increased pressure forces flexible valve 54 to move upwardly from valve seat 53, to permit the flow of gases through openings 50. Once the pressure again decreases below a predetermined level, gravity causes valve 54 to return to its closed position.

Figure 4:
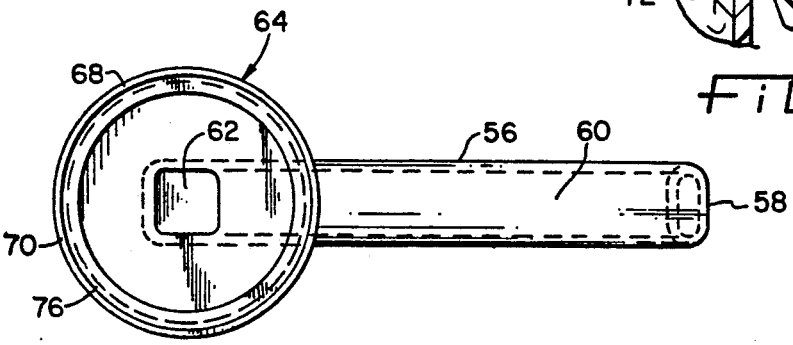
FIG. 4 is an enlarged bottom of the breather assembly of FIG. 1.

In order to secure cup 34 within opening 20, a retaining member 36 is provided and generally comprises a cover 55 and an integral breather tube 56 having an upturned end 58. Retaining member 36 is preferably in the form of a plug and may be made of a variety of elastic or resilient materials, especially natural or synthetic rubbers, and preferably a nitrile rubber. As best shown in FIG. 4, a conduit 60 is formed within tube 56 and is in communication with a vent opening 62 in cover 55 (FIG. 2). Tube 56 may be molded into a variety of configurations, depending upon where the tube is connected. For example tube 56, as shown in FIG. 1, is designed to be attached to the carburetor air inlet (not shown). However, tube 56 may alternatively be vented to the atmosphere.

Figure 3:
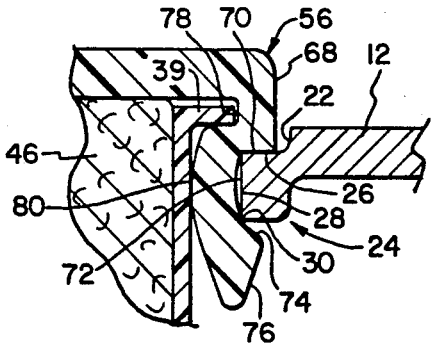
FIG. 3 is an enlarged fragmentary view of FIG. 2, particularly showing the sealing arrangement between a portion of the retaining member and the peripheral edge of the crankcase opening

Referring now to FIGS. 1 and 3, cover 55 includes a top surface 66 and a downwardly extending portion which locks the retainer in place and includes an outer diameter portion 68, a flange or chamfer 70 which engages and is stopped by mating surface 26 of flange 24 upon installation, a recessed or grooved portion 72, an outwardly extending portion 74, and a tapered portion 76. Cover 55 further includes an inner groove 78 which receives lip 39 of cup 34 such that retaining member 36 retains cup 34 to form single breather unit 32.

In order to assemble breather 32, retaining member 36 is attached to cup 34 by first elastically deforming the downwardly extending portion of cover 55 sufficiently to permit cover 55 to be slipped over the top of cup 34 and forced downwardly until inner groove 78 receives peripheral lip 34. At that point, cover 55 returns to its original position such that a seal 80 is formed, as shown in FIG. 3, to prevent the escape of gases between cup 34 and cover 55. The entire breather unit 32 is then inserted downwardly into opening 20 of crankcase 10 until chamfer 70 engages mating surface 26 to positively stop further downward movement of breather 32. It is noted that breather 32 may be inserted into opening 20 without the use of any special tools. Upon insertion, the downwardly extending portion of retaining member 36 deforms as shown in FIG. 3, whereupon groove 72 receives peripheral edge 24 to form a fluid-tight seal therebetween. Portion 74 of retaining member 36 extends radially outwardly of corner edge 30 to form an interference fit therebetween to positively lock cover 55 in opening 20.

Although retaining member 36 is shown as a cover for cup 34, it will be appreciated by those skilled in the art that the retaining member can be positioned anywhere along the outer surface of the breather cup for retaining the cup within the breather opening. In addition, the retaining member can be of any shape or size which would permit the locking portion of the retaining member to secure the cup in position.

It will be appreciated that the foregoing is presented by way of illustration only, and not by way of any limitation, and that various alternatives and modifications may be made to the illustrated embodiment without departing from the spirit and scope of the invention.

What is claimed is:

1. In an internal combustion engine including a crankcase having a crankcase interior, a crankcase breather assembly for venting of combustion gases from the crankcase interior, comprising:

a breather opening in the crankcase for providing communication of gases out from the crankcase interior, said opening including a peripheral edge;

a cup in said opening and including a valve for permitting the venting of gases from the crankcase interior upon a condition of positive crankcase pressure; and a retaining member being interlocked with said cup to form a separate breather unit that is insertable into said breather opening, said retaining member including an outer groove that frictionally receives said peripheral edge thereby retaining said retaining member in said opening.

2. The engine of claim 1, wherein said retaining member is a resilient, readily deformable rubberlike material.

3. The engine of claim 1, wherein said crankcase breather assembly includes means for limiting the extent of axial movement of said retaining member into said breather opening.

4. The engine of claim 3, wherein said retaining member includes an outer flanged portion in contacting engagement with a mating shoulder portion of said peripheral edge for limiting the extent of axial movement of said retaining member into said breather opening.

5. The engine of claim 1, wherein said outer groove and said peripheral edge engage one another to form a seal therebetween to prevent the opening of both gas and liquid therethrough.

6. In an internal combustion engine including a crankcase having a crankcase interior, a crankcase breather assembly for venting of combustion gases from the crankcase interior, comprising:

a breather opening in the crankcase for providing communication of gases out from the crankcase interior, said opening including a peripheral edge;

a cup in said opening and including a valve for permitting the venting of gases from the crankcase interior upon the condition of positive crankcase pressure; and a retaining member being interlocked with said cup to form a separate breather unit that is insertable into said breather opening, said retaining member including a locking portion disposed in said opening at least partially beyond said peripheral edge and forming an interference fit therein to positively lock said retaining member with said opening.

7. The engine of claim 6, wherein a lower region of said locking portion extends radially outwardly of said peripheral edge.

8. The engine of claim 6, wherein the outer surface of said locking portion includes a grooved region which receives said peripheral edge.

9. In an internal combustion engine including a crankcase having a crankcase interior, a crankcase breather assembly for venting of combustion gases from the crankcase interior, comprising:

a breather opening in the crankcase for providing communication of gases out from the crankcase interior, said opening including a peripheral edge;

a cup in said opening and including a protruding lip and a valve for permitting the venting of gases from the crankcase interior upon a condition of positive crankcase pressure; and a retaining member that engages and retains said cup, said retaining member including an inner groove, wherein said protruding lip is received in said inner groove to retain said cup on said retaining member and an outer groove that frictionally receives said peripheral edge thereby retaining said retaining member in said opening.

10. In an internal combustion engine including a crankcase having a crankcase interior, a crankcase breather assembly for venting of combustion gases from the crankcase interior, comprising:

a breather opening in the crankcase for providing communication of gases out from the crankcase interior, said opening including a peripheral edge;

a cup in said opening, said cup defining a breather chamber and including a valve for permitting the venting of gases from the crankcase interior to said breather chamber upon a condition of positive crankcase pressure; and a retaining member that covers, engages and retains said cup, said retaining member including an outer groove that frictionally receives said peripheral edge thereby retaining said retaining member in said opening, said retaining member further including a vent opening therein for venting gases from said breather chamber to the atmosphere.

11. The engine of claim 10, wherein said retaining member includes a breather tube integral therewith, said breather tube being in fluid communication with said vent opening.

12. In an internal combustion engine having a crankcase interior, a method of assembling a crankcase breather assembly for venting gases from the crankcase interior, the method comprising the steps of:

providing an opening in the crankcase, said opening including a peripheral edge;

providing a cup including a valve disposed therein for venting gases from the crankcase interior upon the condition of positive crankcase pressure;

attaching a retaining member including a downwardly extending portion over at least a portion of said cup for retaining said cup and forming a breather unit; and axially inserting said breather unit into said opening such that said downwardly extending portion is compressed inwardly by said peripheral edge to cause a lower tip portion of said downwardly extending portion to deform radially outwardly beyond said peripheral edge, thereby locking said breather unit in place.

13. The method of claim 12, wherein said retaining member includes an outer grove therein, wherein said outer groove frictionally receives said peripheral edge upon inserting said breather unit into said opening to further retain said breather unit in said opening.

14. The method of claim 12, wherein the step of attaching said retaining member to said cup includes inserting a protruding lip of said cup into an inner groove of said retaining member.

15. The method of claim 14, wherein said retaining member is resiliently deformed to enable a lower portion of said retaining member to clear said lip as said retaining member is attached to said cup.

* * * * *